United States Patent [19]

Bomgaars

[11] 3,996,706

[45] Dec. 14, 1976

[54] PIVOT LINK FOR PORTABLE ENCLOSURE

[75] Inventor: Roger Bomgaars, Potterville, Mich.

[73] Assignee: General Aluminum Products, Inc., Charlotte, Mich.

[22] Filed: Sept. 8, 1975

[21] Appl. No.: 611,001

[52] U.S. Cl. ..... 52/71; 52/82; 52/586

[51] Int. Cl.[2] ..... E04B 1/346

[58] Field of Search ..... 52/71, 82, 586, 585, 52/222; 160/231

[56] References Cited

UNITED STATES PATENTS

| | | | |
|---|---|---|---|
| 3,118,186 | 1/1964 | Moss | 52/71 |
| 3,333,373 | 8/1967 | Taylor et al. | 52/82 X |
| 3,335,535 | 8/1967 | Lane | 52/82 X |

*Primary Examiner*—Price C. Faw, Jr.
*Assistant Examiner*—Carl D. Friedman
*Attorney, Agent, or Firm*—Price, Heneveld, Huizenga & Cooper

[57] ABSTRACT

A portable enclosure having a series of panels hingedly affixed together to form a closed polygon. A flexible linking member and a vinyl hinge or sealing strip fixed between adjacent pairs of panels interconnect the panels such that the enclosure can be folded. The pivot link at the upper and lower portions of the panels are basically identical and provide means for securing and retaining a roof structure at the top while the link located at the bottom provides a convenient means for fixing the enclosure to the ground.

14 Claims, 11 Drawing Figures

PIVOT LINK FOR PORTABLE ENCLOSURE

BACKGROUND OF THE INVENTION

This invention relates to portable structures having a plurality of hingedly connected panel members and a roof, and more particularly to a novel means for interconnecting the adjacent panels such that they may be folded when not in use.

Portable enclosures of the type shown generally in the U.S. Pat. Nos. 3,118,186; 3,134,200; 3,333,373; and, commonly assigned U.S. Pat. No. 3,335,535 have become increasing popular in recent years. Basically, these enclosures comprise a plurality of wall panels hingedly affixed together and adapted to be placed on end and closed about one another to form a polygonal wall enclosure. The wall panels are staked or otherwise affixed to the surface upon which the enclosure is resting. Generally, the wall enclosure is covered by means of a dome-shaped roof having a plurality of support members extending from a central hub and affixed to the upper edge of the enclosure between adjacent panels. A suitable covering is placed over the supports.

In these prior structures, stability is provided by means of a pair of flexible cables encircling the wall enclosure at the bottom and top thereof. The upper cable members are also used as a means whereby the roof members may be affixed between the panels and the lower cable is utilized to affix the enclosure to the surface as by stakes. The cables function additionally to maintain the closed polygonal relationship of the panels. One of the difficulties encountered in the assembly of such structures resides in the attachment and securement of the flexible cable at the upper and lower portions to secure the several panels together.

As outlined in commonly assigned U.S. Pat. No. 3,335,535 issued on Aug. 15, 1967, to D. W. Lane and entitled CABLE RETAINING ASSEMBLY, portable structures of this type have been extremely susceptible to vertical separation under the influence of excessive winds. In the commonly assigned patent, vertical stability is achieved by providing means for fixing the flexible cables to the upper and lower edges of the panel enclosure. This fixing means includes a cable retaining clip adapted to slide into recesses formed at the edges of each of the panels. These clips, formed of a resilient material, such as nylon or Delron, engage the cable and the panel to form a more rigid structure to prevent vertical separation of the components during abnormal wind conditions. The clips have tabs or detents which engage slots in the side edges of the panel framework for positive locking in position.

SUMMARY AND OBJECTS OF THE INVENTION

Although the structure described was significant advance in the art, it yet remains desirable to simplify the "on site" assembly of such portable structures while still providing a satisfactory means for connecting adjacent panels together. It is also desirable to provide a simple means to secure the roof supports to the side walls and the structure to the ground. Further it is desirable to minimize component and fabrication costs of the enclosure without a corresponding sacrifice of quality.

The present invention accomplishes the foregoing desirabilities by providing a novel flexible pivot link structure for the top and bottom interconnections of the panels and a vinyl hinge and seal pivotally interconnecting adjacent pairs of panels. The upper link also provides a means for retaining the roof supports in a fixed relationship to the panels while the lower link provides a means for securing the enclosure to a surface. Many other objects and advantages of the present invention will be readily understood by those skilled in the art with reference to the following specification and accompanying drawings.

DESCRIPTION OF THE PREFERRED EMBODIMENT

Figure 1:
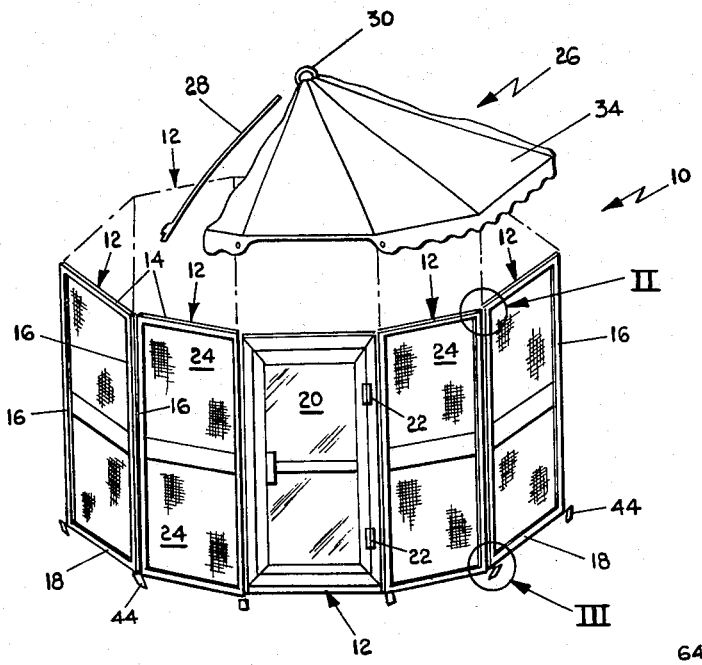
FIG. 1 is a fragmentary perspective view of the portable structure embodying the teachings of this invention.

Referring now to the drawings and in particular to FIGS. 1 through 4, the portable enclosure generally designated by the numeral 10 comprises a pluraltiy of interconnected panels 12. Each panel 12 is an individual section having a periphery formed of a plurality of elongated preferably extruded frame members including a top horizontal member 14, vertical side members 16 and a horizontal bottom member 18 secured together at the corners. The corners of the top, side and bottom frame members are secured together by a conventional corner lock or key (not shown) positioned within the hollow interior of the top, side and bottom frame members to form a rigid juncture therebetween. The corner lock is secured therein in a conventional manner as by welding or the like. The corner lock itself forms no part of the present invention and will not be described in greater detail.

A door panel 20 is mounted by hinges 22 in the framework of at least one of panels 12 to provide access to the interior of the enclosure. Individual panels 12 are typically screened at 24 in conventional fashion. Opaque privacy panels which may or may not be of the selfstoring type may also be provided to accommodate varying weather conditions.

The roof assembly 26 includes a plurality of tube members 28 and a central hub or spider 30 interconnecting the tubes centrally and above the enclosure. The support tubes are compressed during installation to bow downwardly in generally dome-shaped fashion.

Each is fixed at the enclosure between adjacent pairs of panels 12. The tube extremities are retained at the positions by means of hook-like sections 32 which engage an upper cable member in the manner indicated in FIG. 4. A weather proof top covering 34 of vinyl or the like covers the enclosure in a conventional manner. The portable enclosure thus far described is conventional in the art.

With additional reference to FIGS. 5 –11, adjacent pairs of panels 12 are hingedly connected together by an elongated vinyl sealing strip or hinge 36 and a link assembly 40. Link assembly 40 includes a length of aircraft cable 42 or other high strength flexible material to form the means at the top of the enclosure between adjacent panels 12 to engage the hook-like section 32 of the support tubes. A similar link assembly 40 is also positioned between adjacent panels 12 at the bottom of the enclosure to provide means for engaging a stake 44 (FIGS. 1 and 3) or similar anchoring mechanism whereby the enclosure is secured to the ground.

Top frame member 14, side frame member 16 and bottom frame member 18 are identical in cross sectional configuration. With reference to FIGS. 5 and 9-11, each frame member is generally rectangular in cross section and may include decorative ribbing or trim 50 extending along its outer side surfaces. A channel-like recess 52, generally in the shape of a "T" slot, extends along the length of each frame member. The frame members may be formed as an extrusion and have a generally rectangular hollow interior 54 defined by an outer peripheral edge wall 56 in which slot 52 is formed, a pair of side walls 58 in which the decorative trim 50 is formed, and an inner peripheral edge wall 60.

An L-shaped rib 62 is integrally formed with inner wall 60 with the base of the "L" facing outwardly toward outer wall 58 thereby form a generally U-shaped channel. The U-shaped channel forms a means by which screen 24 is secured to the panels in conventional fashion. Walls 56, 58 and 60 cooperatively define the interior recess 54 into which the previously mentioned corner lock (not shown) is inserted to hold the panels together.

T-shaped slot or channel 52 is defined by a pair of upstanding legs 64, and a pair of inwardly directed flanges 66. The T-shaped slot 52 on side channels 13 is adapted to receive and retain the vinyl sealing strip or hinge 36. Hinge 36 includes an elongated central body portion 68 (FIGS. 2 and 11) and a pair of T-shaped head portions 70 at opposite sides of body portions 68. The T-shaped heads 70 are received in channels 52 formed in vertical frame members 13 of adjacent panels. The T-shaped portions at the top ends of sealing strip 36 are cut away a short distance along the length as shown at 72 (FIG. 2) such that the ends of the sealing strip are movable to allow insertion of the hook-like section 32 of roof assembly 26.

Figure 6:
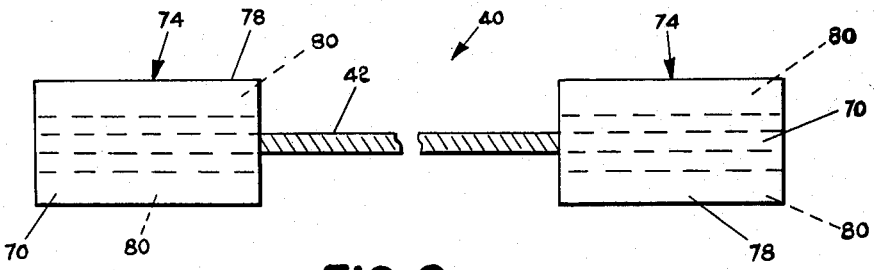
FIG. 6 is a top plan view of the linking member of the invention.
Figure 7:
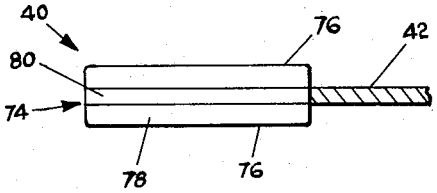
FIG. 7 is a fragmentary side view of the linking member of FIG. 6.
Figure 8:
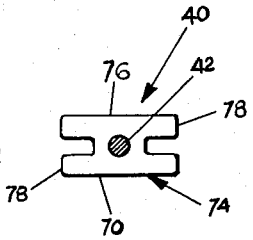
FIG. 8 is an end view of the link of FIGS. 6 and 7.

Flexible link 40 is shown in greater detail in FIGS. 6, 7 and 8 and includes the previously mentioned length of cable 42 having a pair of slugs or retaining elements 74 formed at each end. Cable 42 may be formed of multi-strand galvanized aircraft cable of about 1/16 to ⅛ inch in diameter. It will be recognized, of course, that other high strength flexible materials may be used with equal facility. The retainer element or slug 74 is preferable molded or cast in place at the cable ends. The retainer element is preferably formed of nylon, Celcon or other suitable plastic-like injection moldable material. Preferably, the retainer element or slug is injection molded directly to the end of the cable. Alternately, the slug may be formed as by die cast zinc or similar metallic material. Prior to molding or die casting, the cut ends of the cable (not shown) are slightly frayed for better retention in the material.

Slug 74 is generally H-shaped in configuration, the sides of the H-forming top and bottom wall surfaces 76 and the edges forming side walls 78. Side walls 78 each have a groove or slot 80 formed therein extending along its length. Slots 80 in each side are adapted to slide over and move along flanges 66 formed along the length of the channels 52 formed along the horizontal top and bottom frame members 13 and 14. Links 40 positioned at the top and bottom of the structure between adjacent panels are basically identical in construction except that the link positioned at the bottom of the structure includes a slightly greater length of cable whereby the cable may be twisted into a loop 82 (FIG. 3) for engagement by a hook 84 formed on stake 44 or other anchoring mechanism to secure the structure to the ground.

Figure 5:
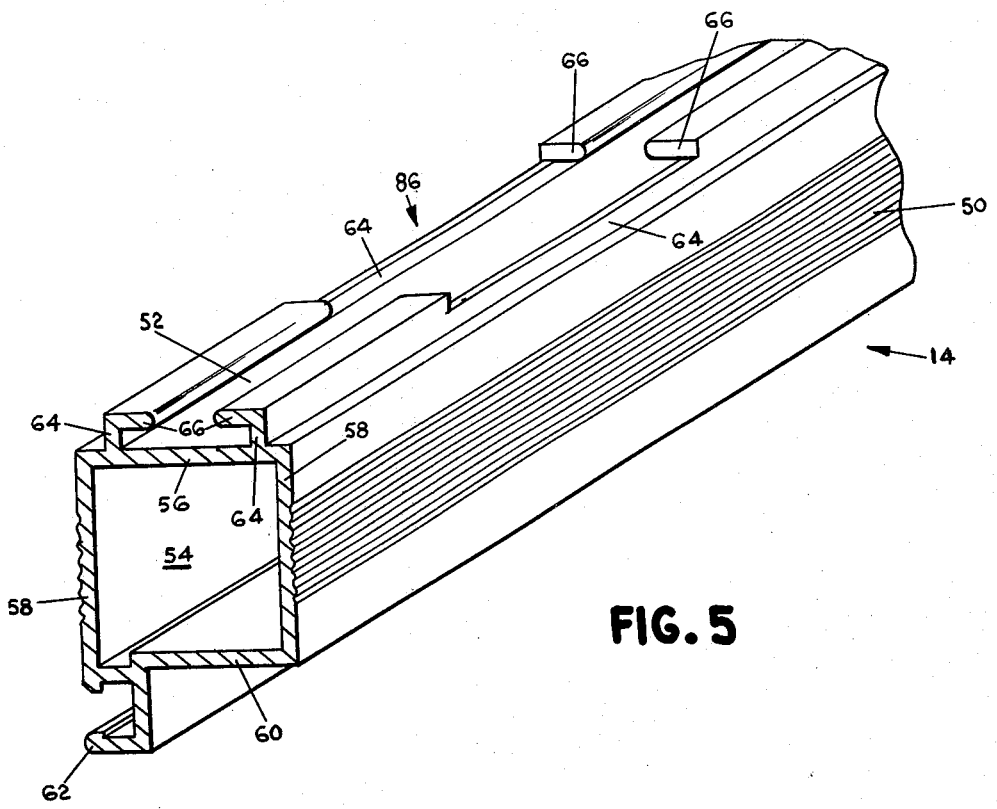
FIG. 5 is a fragmentary perspective view of a typical horizontal frame portion of an individual panel.

With reference again to FIGS. 2, 5 and 9, the upper and lower frame members 12 and 14 have a portion cut away to form an opening 86 to provide an entrance opening such that slug 74 may be introduced in the channel-like recess or T-slot 52. Opening 86 is formed by removing a portion of flanges 66 such that only legs 64 extend upwardly as shown in FIG. 5. The length of opening 86 is just slightly greater than the length of slug 64.

Figure 2:
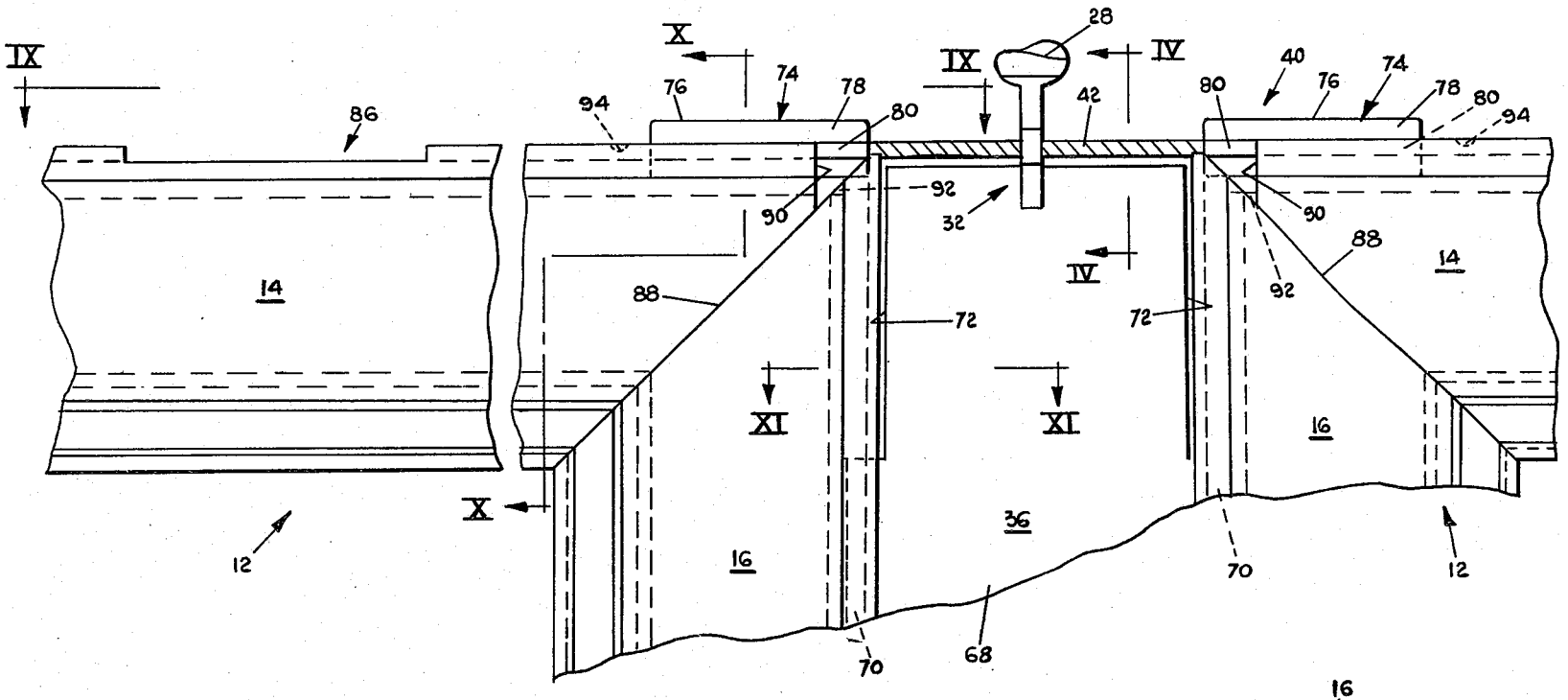
FIG. 2 is an enlarged fragmentary elevation view of the linking member interconnecting a pair of adjacent panels as viewed along the arrow indicated II in FIG. 1.
Figure 11:
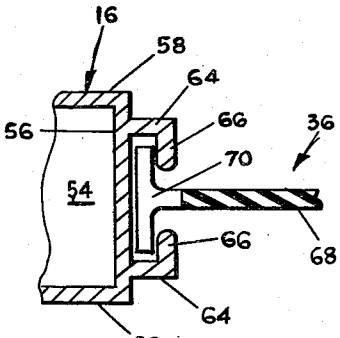
FIG. 11 is a fragmentary cross sectional view of the vertical support member and hinge as viewed along the plane XI—XI of FIG. 2.
Figure 3:
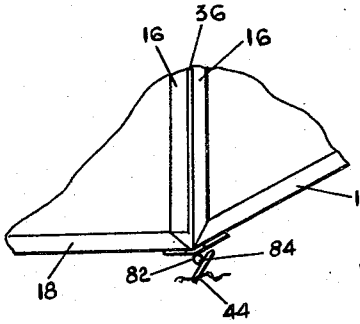
FIG. 3 is a fragmentary perspective view taken along the arrow designated III in FIG. 1 illustrating the linking member at the lower portion of the structure.

With reference to FIG. 2, the intersection to top horizontal member 14 with vertical member 16 is formed with conventional mitered corners 86. In addition to opening 86 formed in the horizontal member, the ends of the horizontal member are cut slightly back along a line 90 perpendicular to channel recess 52 such that a slight amount of the surface of slug 64 is visible at the intersection of horizontal frame member 14 with vertical frame member 16. Cut 90 allows the insertion of the head 70 of sealing strip 36 into channel 52 formed in the vertical frame member 16.

Figure 9:
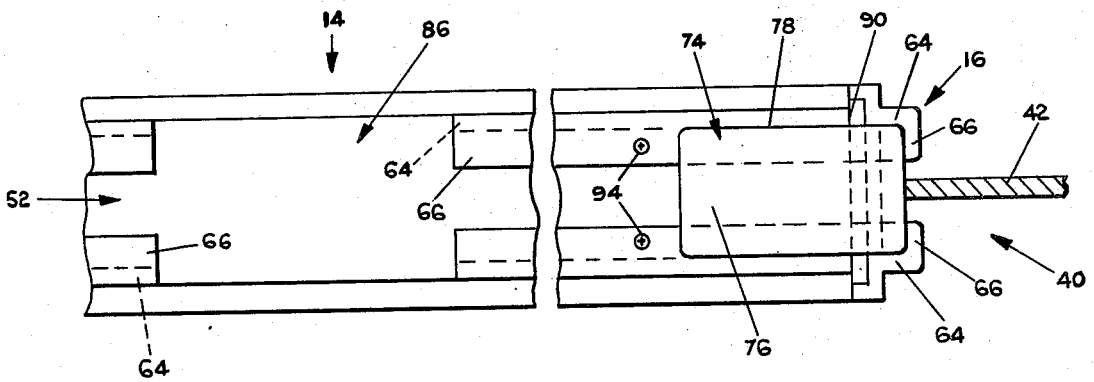
FIG. 9 is a fragmentary top plan view of the horizontal panel member as viewed along the plan IX—IX of FIG. 2.

Linking member is inserted in channel 52 of frame member 14 by simply fitting slug 74 into opening 86 and sliding grooves 80 along flanges 66 of channel 52 until the slug comes into abutment with the inner surfaces of flanges 66 formed in the vertical frame member 16 (FIGS. 2 and 9). A slight offset or cut 92 is also made in vertical frame member 14 along the width of outer edge wall 56 to compensate for slight misalignment of the mitered corners to allow movement of slug 74 into abutment with flanges 66.

After the slugs are positioned in adjacent horizontal panels, flanges 66 of the horizontal frame member may be staked or dimpled as indicated at 94 (FIG. 9) to prevent the slug from shifting along channel 52.

In the preferred embodiment, the length of cable 42 forming the link assembly installed at the top of the enclosure between adjacent panels is approximately equal to the length of body portion 68 of hinge 36. Since both hinge 36 and link 40 are flexible, they can be installed between adjacent panels without interference. Preferably, slug portions 74 of individual link assemblies are installed in adjacent panels when the panels are stacked at assembly and prior to shipment. Typically the enclosure is factory pre-assembled with sealing strips 36 and link assemblies 40 positioned between adjacent panels. During pre-assembly, a number of individual panels, depending on the total number of sides the completed structure is to include, are stacked in alternate back-to-back and face-to-face relationship such that the vertical edges of adjacent panels are positioned side-by-side. Hinges 36 are then partially folded with the head portions 70 toward each other and the heads 70 are introduced into channels 52 of adjacent panels. The ends 72 of flexible links 40 are similarly folded as required so that slugs 74 can be placed in openings 86 at the top and bottom of adjacent panels and shifted into abutment with flanges 66 of the vertical frame members. Finally, the slugs are staked in place as previously mentioned. One panel is not so secured however such that the entire assembly is folded in accordian-like fashion.

Figure 4:
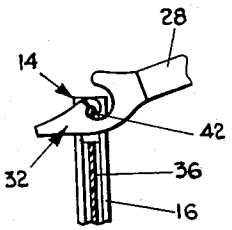
FIG. 4 is a fragmentary cross sectional view taken along the plane IV—IV of FIG. 2.
Figure 10:
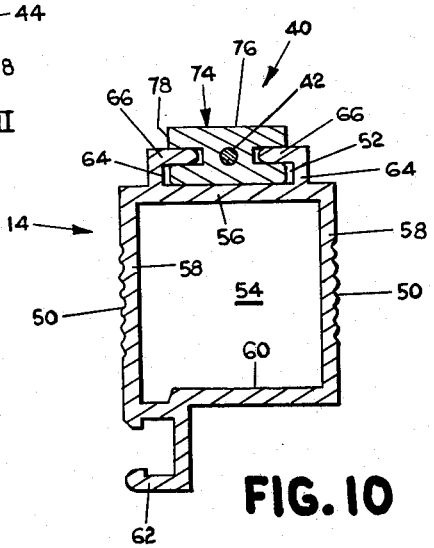
FIG. 10 is a fragmentary cross sectional view of the horizontal member and link taken along the plane X—X of FIG. 2.

Assembly of the portable enclosure is accomplished similar to that well known in the prior art. The flexible support cables extending around the enclosure at the top and bottom thereof have been eliminated, however, and the assembly therefore is considerably simplified. Basically, the pre-assembled accordian folded panels are stood on end and opened such that the adjacent panels at the ends can can be secured together by the vinyl sealing strip and link assembly as previously described. Tubes 28 forming a part of the roof structure 26 are slipped into position as shown in FIG. 4 and the fabric top covering 34 is stretched over the sides and over the nose piece at the hook-like end portion. The stakes are hooked over the twisted loop 82 formed in lower link assembly 40 and are driven into the ground. The portable enclosure is then ready for use. All pre-assembly is accomplished prior to delivery to the user and therefore no bolts or nuts are employed and no tools are required to erect the portable enclosure of the invention.

Those skilled in the art will immediately recognize that the novel combination of the flexible hinge and seal 36 together with the link assembly 40 retained at the upper and lower portions of the panel will allow adjacent pairs of panels to fold with respect to each other for shipment and storage. The controlled length of cable 42 positioned at the upper portion of adjacent panels 12 prevents them from pulling apart and serves as a convenient means by which the hook-like sections 32 at the ends of tube members 28 of the top structure may be secured to the panels as illustrated in FIG. 4. In addition, the extra length of cable 42 at the bottom of the enclosure provides the means by which a stake 44 at the lowermost portion may be used to secure the enclosure to a surface.

Those so skilled will also recognize that many modifications can be made to the unique link assembly of the invention and it is intended that the equivalent arrangements are to be included as part of this invention unless the following claims by their wording expressly state otherwise.

The embodiments of the invention in which an exclusive property or privilege is claimed are defined as follows.

1. A portable enclosure including a series of panels hingedly connected together to form a closed polygon; one of said panels including a door to permit entry into and egress from said enclosure; a series of roof supporting members interconnected centrally and above said enclosure, said supports sloping downwardly in generally radial fashion and being affixed to said panels; and a flexible roof overlying said supports, each of said panels including upper and lower spaced horizontal frame members and a pair of spaced vertical members forming a rectangle; and linking means pivotably interconnecting adjacent pairs of said panels at the upper and lower horizontal members; said linking means comprising: at least one elongated individual flexible member extending between each adjacent pair of said panels; retainer means attached to each end of said flexible member for securing said flexible member to said horizontal members of adjacent panels to extend therebetween; and sealing means positioned between said panels, said flexible member allowing said adjacent panels to move relative to one another and said sealing means closing the gap therebetween.

2. The enclosure of claim 1 wherein at least one of said upper and lower horizontal members has an elongated channel formed therein and means in said channel and said retainer means for receiving and retaining said retainer means.

3. The enclosure of claim 2 wherein said channel includes a base, a pair of side walls and a pair of converging sections extending from said side walls; said retainer means having channels formed therein to receive said converging sections.

4. The enclosure of claim 3 wherein a portion of said pair of said converging sections is removed forming an entrance opening along the length of said channel to receive said retainer means.

5. The enclosure of claim 3 wherein each of said upper and lower horizontal members has an elongated channel formed therein and wherein said retainer means is positioned in said upper and said lower horizontal members.

6. The enclosure of claim 5 wherein a portion of said pair of said converging sections is removed forming an entrance opening along the length of said channel to receive said retainer means.

7. The enclosure of claim 1 wherein each said flexible member comprises a cable, said retainer means being molded at the ends of said cable, said retainer means and said adjacent panels each having cooperating engagement means thereon for securing said retainer means to said adjacent panels; said roof supporting members having means formed therein engageable with said cable to affix said supporting members with respect to said panels.

8. The enclosure of claim 7 wherein said sealing means comprises an elongated strip of flexible material positioned between said panels; means on said strip and panels for securing same together, said sealing means and said cable cooperatively forming a hinge between said panels.

9. The enclosure of claim 1 wherein said flexible member comprises a cable secured to said adjacent panels, said retainer means including the ends of said cable each having an element formed thereon; and engaging means on said elements and said panels for securing said flexible member therebetween.

10. The enclosure of claim 9 wherein said sealing means comprises an elongated strip of flexible material positioned between said panels; securing means on said strip and said panels for securing same together, said sealing means and said cable cooperatively forming a hinge between said panels.

11. The enclosure of claim 10 wherein said strip of sealing material is generally I-shaped in cross-sectional configuration, the parallel ends of said I-shaped forming said securing means on said strip, said spaced vertical members of said panel each having a channel formed therein to receive said securing means on said strip.

12. A portable structure having a plurality of rigid panel members and a door hingedly affixed to one another in side-by-side relationship and adapted to be positioned on a surface to form a generally polygonal enclosure, each of said panel members having a horizontal channel-like recess formed along the top, bottom and side edges thereof, said recess having a base, side walls and converging sections extending from said side walls; individual flexible connecting means positionable between each said adjacent pair of panels at said top and said bottom edges; means on each said flexible connecting means for affixing said connecting means to said adjacent panel members, said connecting means furnishing vertical support for maintaining the vertical stability of said structure; said affixing means including said flexible connecting means comprising a cable member and a pair of slug members fixed at opposite ends of said cable member; said slug members being integrally molded on the ends of said cable member and adapted to slide into said channel-like recess, and means formed on said slug members to receive said converging sections of said channel-like recess for retention thereby.

13. The enclosure of claim 12 wherein a portion of said pair of said convergng sections forming said channel-like recess on said top and said bottom edges is removed forming an entrance opening along the length of said channel to receive said slug members.

14. The portable structures of claim 12 and further including: sealing means extending between the side edges of said adjacent panels to close the gap therebetween, said sealing means having a flange formed thereon engageable with said converging sections of said channel-like recess for securing said sealing means between said adjacent panels, said sealing means and said cable member cooperatively forming a hinge between said panels.

* * * * *